US005917916A

United States Patent [19]

Sibbald et al.

[11] Patent Number: 5,917,916

[45] Date of Patent: Jun. 29, 1999

[54] AUDIO REPRODUCTION SYSTEMS

[75] Inventors: Alastair Sibbald, Maidenhead; Richard David Clemow, Gerrards Cross, both of United Kingdom

[73] Assignee: Central Research Laboratories Limited, Hayes, United Kingdom

[21] Appl. No.: 08/851,721

[22] Filed: May 5, 1997

[30] Foreign Application Priority Data

May 17, 1996 [GB] United Kingdom ..... 9610394

[51] Int. Cl.[6] ..... H04R 5/00

[52] U.S. Cl. ..... 381/1; 381/123; 381/74

[58] Field of Search ..... 381/1, 74, 309, 381/123, 11, 103, 81

[56] References Cited

U.S. PATENT DOCUMENTS 4,349,698 9/1982 Iwahara .
5,056,148 10/1991 Hayashi ..... 381/11
5,161,198 11/1992 Noble ..... 381/81
5,448,646 9/1995 Lucey et al. ..... 381/74
5,581,626 12/1996 Palmer ..... 381/103

FOREIGN PATENT DOCUMENTS

94/22278 9/1994 WIPO .
95/15069 6/1995 WIPO .

*Primary Examiner*—Vivian Chang
*Attorney, Agent, or Firm*—Evenson, McKeown, Edwards & Lenahan, PLLC

[57] ABSTRACT

Stereophonic sound reproduction apparatus comprising an input means (2) for producing binaural signals, cross-talk cancellation means, (10) loudspeaker means, (20, 22) headphone means, (26) and a switch means (12, 18, 24, 30, 32) which in a first position (plug 24 not inserted in socket 18) couples the binaural signals from the input means (2) to the loudspeaker means (20, 22) through the cross-talk cancellation means (10) and in a second position (plug 24 inserted in socket 18) renders the cross-talk cancellation means (10) inoperable and couples the binaural signals from the input means (2) to the headphones (26).

5 Claims, 4 Drawing Sheets

AUDIO REPRODUCTION SYSTEMS

This invention relates to audio reproduction systems, and more particularly to stereophonic systems employing binaural sound processing.

The processing of binaural signals to produce highly realistic three-dimensional sound images is well known, see for example our International Patent Application No. WO 94/22278. Binaural technology is based on recordings made using a so-called "artificial head" microphone system, and the recordings are subsequently processed digitally. The use of the artificial head ensures that the natural three-dimensional sound cues—which the brain uses to determine the position of sound sources in three-dimensional space—are incorporated into the stereo recording. Subsequent signal-processing of the binaural signals anticipates the transaural crosstalk which occurs when listening to the recordings via loudspeakers, and ensures that this transaural crosstalk is cancelled. Crosstalk occurs when an audio signal intended for one ear of a listener is also received by the other ear, and its cancellation ensures that the three-dimensional cues are effective on playback of the material, such that the brain can interpret the cues correctly. Without such processing, the recordings sound tonally incorrect and do not reproduce their three-dimensional attributes through loudspeaker auditioning.

For the purposes of the present specification, the term "binaural signals" is intended to mean two-channel or stereophonic signals which include one or more components representing audio diffraction effects created by an artificial head means positioned between a pair of spaced apart microphones. The artificial head means may be, as is common, a precise model of a human head and torso, with microphones in the ear structures; alternatively it may be something far less precise, for example a block or sheet of wood positioned between a pair of spaced microphones, which nevertheless creates diffraction signals from the source of sound signals; it might even be an electrical synthesis circuit or system which creates and applies such a signal component to stereophonic signals. The binaural signals may be transmitted directly from an artificial head means; alternatively they may be reproduced from a recording. As stated above, it is necessary when such signals are reproduced through loudspeakers that the signals have undergone processing for crosstalk cancellation.

Crosstalk cancellation is unnecessary, however, and indeed positively disadvantageous, if the listener chooses to employ headphones rather than loudspeakers to listen to the reproduced sound, since as the headphone speakers are isolated from one another, transaural crosstalk does not arise. Headphones may be used for example with an electronic musical instrument when it is desired to practice without creating a noise disturbance, or for monitoring a recording in a noisy environment. This clearly creates a problem in circumstances where users might wish to listen via either loudspeakers or headphones; it is an object of the present invention to overcome this problem.

In order to recreate realistic three-dimensional sound images, it is not only desirable to be able to switch on and off the crosstalk cancellation, depending on whether one is listening to the loudspeakers or through headphones, but it would be advantageous to be able to compensate for the "twice through the ears" effect for both modes of listening as is explained in our International Application Nos. WO 94/22278 and WO 95/15069.

Compensation for the "twice through the ears" effect uses audio filters to shape, or equalise, the spectral response of the sound recorded via the artificial head. The transfer function used for this shaping can be calculated in different ways. For listening through headphones, headphone-to-ear transfer functions are calculated, and these functions differ from one headphone type to another. For listening to loudspeakers some practitioners use loudspeaker-to-ear transfer functions, and these functions are dependent both upon the angle of incidence of the sound from the loudspeaker to the ear and the distance from the loudspeaker to the ear.

A further object of the present invention is to provide a means whereby, if desired, in addition to cancelling interaural crosstalk when listening to sound from a loudspeaker, it is possible to alter the equalisation applied so that different transfer functions are used when listening to sound from loudspeakers compared to those used to listen to sound from headphones.

According to one aspect, the present invention provides a stereophonic sound reproduction apparatus comprising an input means for producing binaural signals, cross-talk cancellation means, loudspeaker means, headphone means, and a switch means which in a first position couples the binaural signals from the input means to the loudspeaker means through the cross-talk cancellation means and in a second position renders the cross-talk cancellation means inoperable and couples the binaural signals from the input means to the headphones.

Preferably there is provided a socket means for receiving a jack plug of said headphone means, said socket means including detection means operable to detect insertion of the jack plug in said socket means and in response thereto to switch the switch means to said second position.

The socket means may be incorporated in a signal distribution means which is operable to provide output binaural signals to said loudspeaker means.

Preferably there is provided a signal processing means which includes binaural placement filter means for generating left and right binaural signals, the input means is operable to produce a monophonic output audio signal, and the signal processing means is operable to receive said output signal and send said left and right binaural signals either through said cross-talk cancellation means to a respective left and right loudspeaker of said loudspeaker means when the switch means is in said first position or to a respective left and right headphone of said headphone means when said switch means is in said second position.

In a further aspect of the invention the signal processing means further includes equalisation filter means, said equalisation filter means being selectively switchable by said switch means to a first state when the switch means is in said first position, where the transfer function of the equalisation filter means corresponds to that for a listener listening to sound from said loudspeaker means, to a second state where the transfer function of the equalisation filter means corresponds to that for the listener listening to sound from said headphone means.

The equalisation filter means has a transfer function "normalised" using a transfer function which corresponds for a listener listening to sound reproduced by the loudspeaker means and a correction means is provided which is operable when the switch means is in said second position to receive binaural signals supplied to the loudspeaker means and apply thereto a correction signal so as to alter the binaural signals and supply corrected binaural signals to said headphone means.

In order that the invention may be clearly understood and readily carried into effect, two embodiments thereof will now be described, by way of the accompanying drawings of which:

DESCRIPTION OF THE PREFERRED EMBODIMENT

Figure 1:
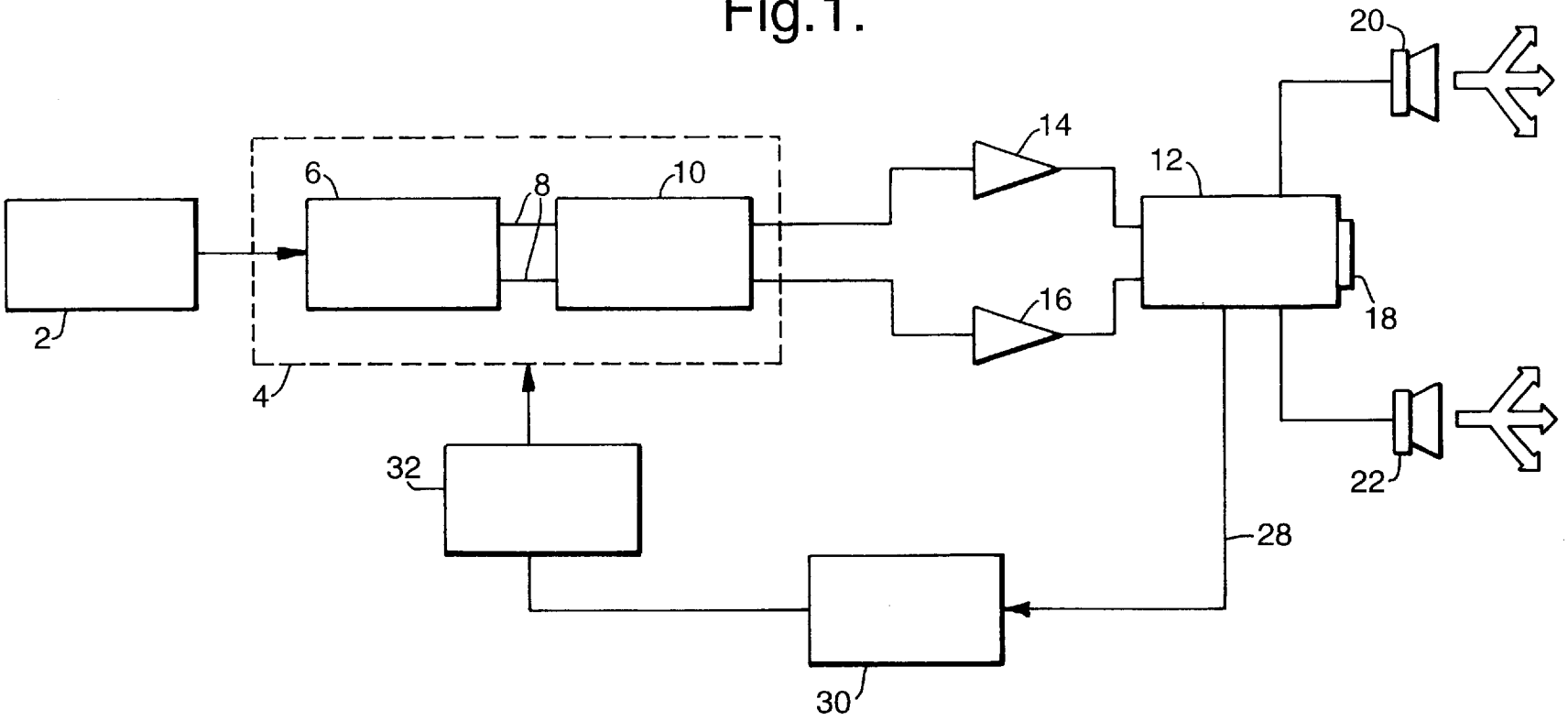
FIG. 1 is a block diagram of the one embodiment configured for loudspeaker listening.

The preferred embodiment of the present invention provides a means for providing both headphone- and loudspeaker-formatted signals from a 3D-sound reproduction system of the type described in our International Patent Application WO94/22278. In accordance with the present invention the system comprises a detection means, suitable for detecting the coupling of headphones into the system, and a controller means for modifying the digital signal-processing algorithms such that appropriate headphone-compatible signals are produced at the system output. When the use of headphones is detected, the controller configures the digital filters which are carrying out the signal-processing algorithms to omit the crosstalk-cancellation stage of processing When the headphones are not detected, the crosstalk-cancellation algorithm is invoked once more (the default situation is for loudspeaker auditioning).

Referring now to the drawings, in which common features carry the same reference numbers, an input device 2, such as for example a sound synthesizer chip on a PC sound-card, provides an electrical monophonic audio signal which is supplied to a digital sound processor 4, (indicated schematically within the dashed outline) containing binaural placement filters 6 for generating left and right dual channel binaural signals on lines 8 to crosstalk cancellation filters 10. The dual-channel output from the processor 4 feeds an output signal to a distribution component 12, via respective amplifiers 14 and 16.

The component 12 incorporates a headphone socket 18. Component 12 normally distributes output binaural signals to a pair of loudspeaker enclosures 20, 22. In the event that a headphone plug 24 (FIG. 2) is inserted into socket 18, the output signals are instead provided to headphones 26. In addition, a control signal is provided to a control path 28 including a detector device 30 which provides a detect signal to a micro controller 32, in turn providing control signals to processor 4.

In use, in the event that the loudspeakers 20, 22 are being used for listening, the control path may be rendered inactive, or it may merely provide an advisory signal to the processor 4 indicating that crosstalk cancellation may be employed. This arrangement is shown in FIG. 1.

Figure 2:
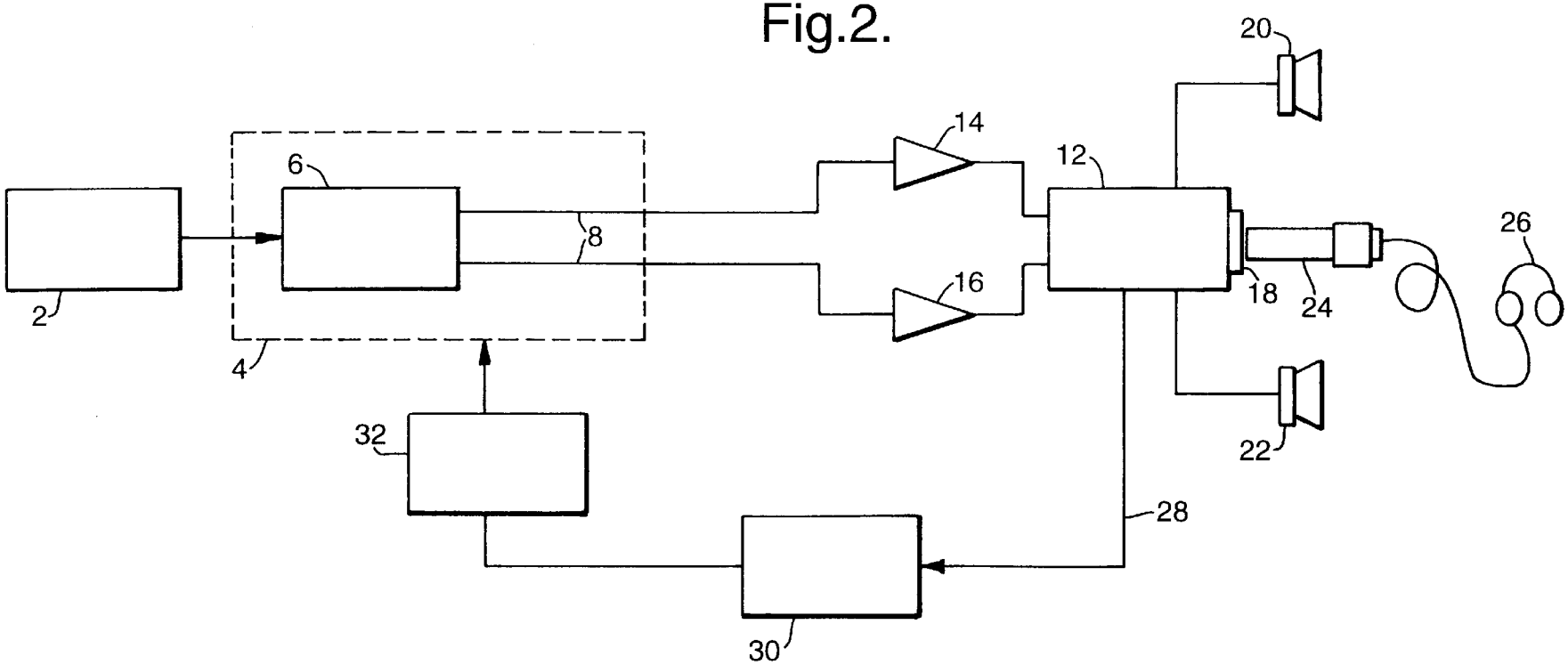
FIG. 2 is a block diagram of the embodiment of FIG. 1 configured for headphone listening.

If on the other hand, and as shown in FIG. 2, headphones 26 are being used for listening, the insertion of the headphone jack plug 24 into the socket 18 is sensed and used to advise the processor 4, via the control path 28 that crosstalk cancellation should not be employed. The micro controller 32 is effective to switch the crosstalk filters 10 (FIG. 1) out of circuit. The binaural placement filters 6 of course still remain active.

The detection of headphone coupling via socket 18 may be achieved in a number of ways, as follows:

(a) use of the existing common, switched connection on the headphone socket;

(b) detection of a small DC current passing through the headphones by applying a current-limited bias voltage to one or both of the live audio feeds;

(c) detection of a small AC current passing through the headphones by applying an AC-coupled, AC bias voltage to one or both of the live audio feeds;

(d) use of a switch contact on the headphone jack socket; or (e) use of an optical beam in part or all of the headphone socket.

It will be apparent to the person skilled in the art how to implement any of these alternatives.

Figure 3:
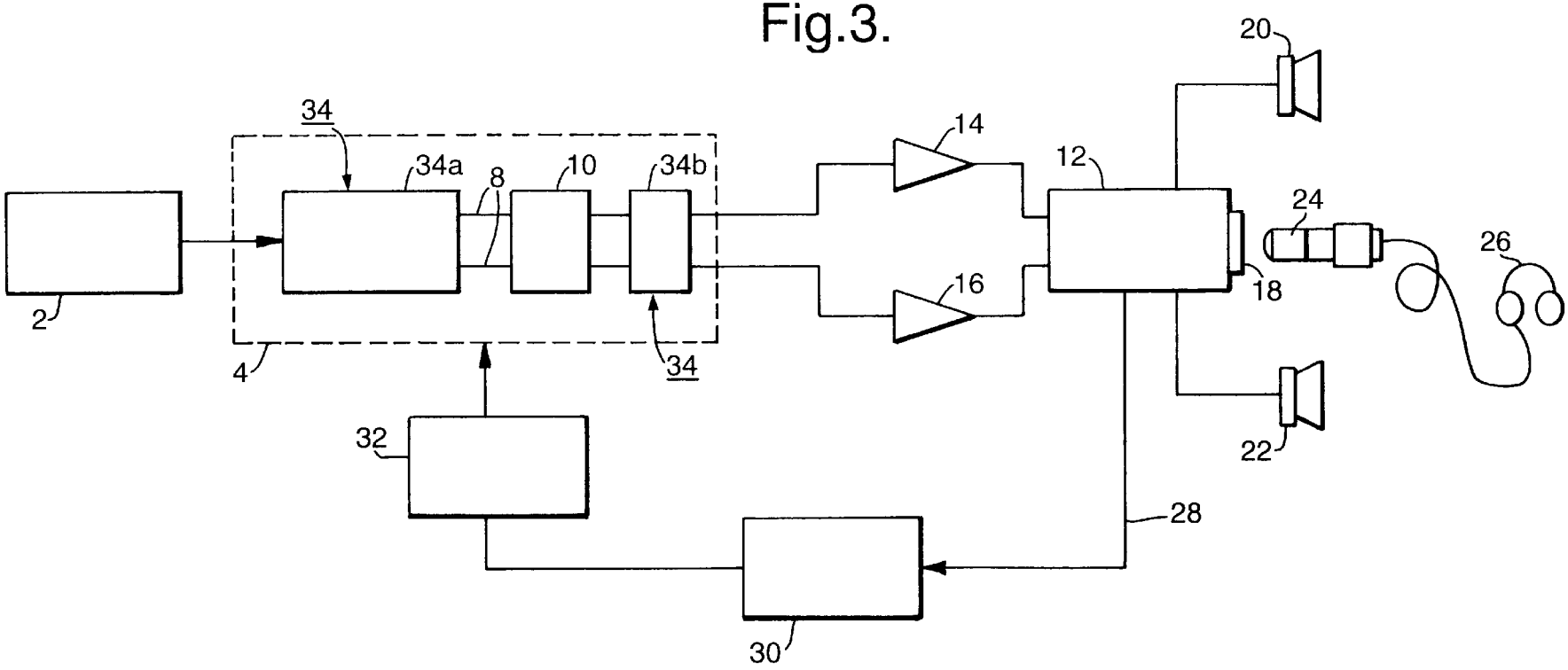
FIG. 3 is a block diagram of a further embodiment configured for loudspeaker listening.
Figure 4:
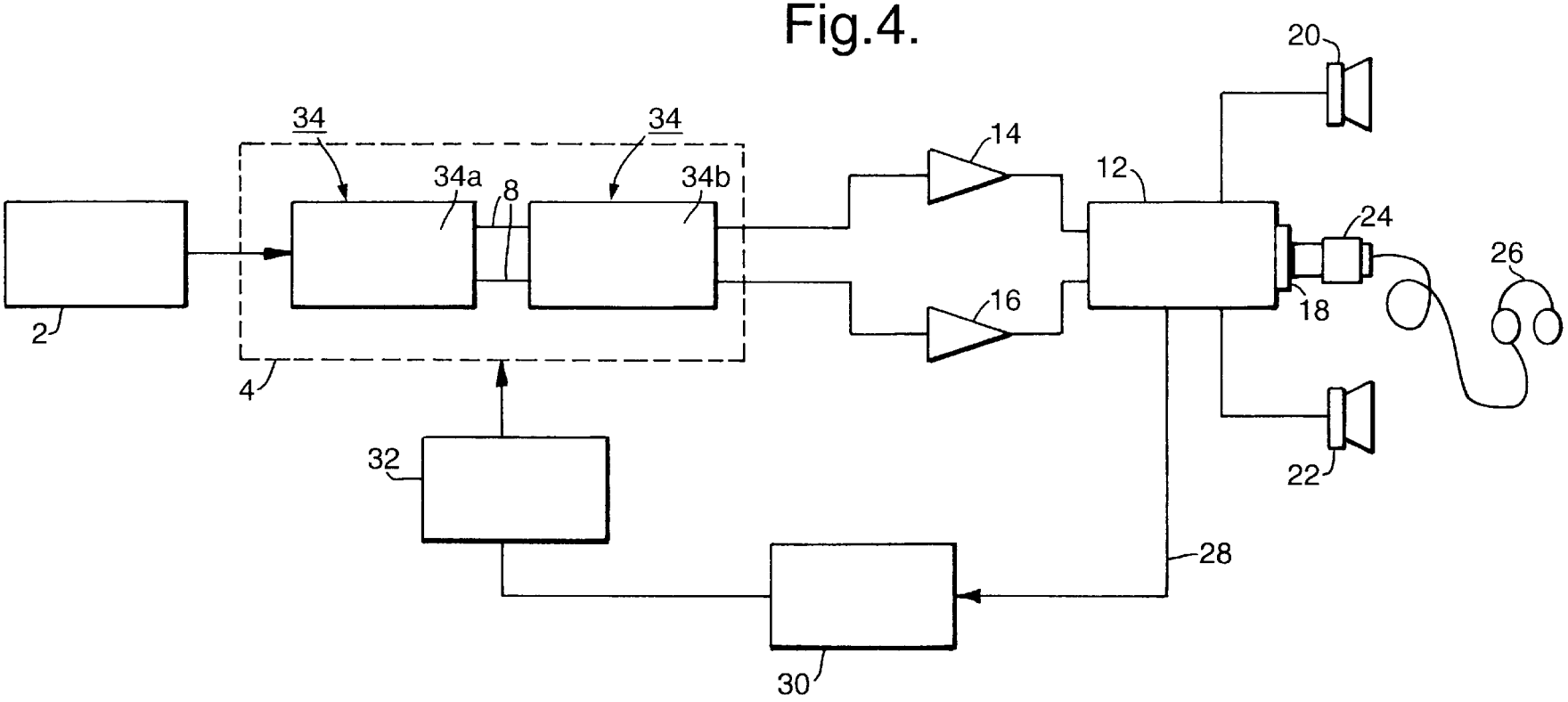
FIG. 4 is a block diagram of the embodiment shown in FIG. 3 but configured for headphone listening.

The present invention may also be used in a binaural sound processing system of the type which employs spectral equalisation filters to compensate for the "twice through the ears" effect as well as filters to synthesise the effects of three-dimensional placement of sound sources. Hence instead of simply switching off the cross-talk cancellation as shown in FIG. 2 when the headphones are connected, it would be even better to switch the equalisation circuits from one state that compensates for the "twice through the ears" effect using loudspeakers at ±30° azimuth to a second state where the equalisation circuits compensate for headphones placed at ±90°. FIGS. 3 and 4 show one such embodiment.

Referring to FIG. 3, an input source 2, such as for example a sound synthesizer chip on a PC sound-card, provides a monophonic audio signal to a digital sound processor 4 containing head response transfer function (HRTF) filter pair 34*a,* for generating left and right channel binaural signals on lines 8 and a crosstalk cancellation filter 10. The processor 4 includes a pair of equalisation filters 34*b* for tonal correction. As in FIG. 2, the dual channel output from the processor 4 feeds an output signal to a distribution component 12, via respective amplifiers 14 and 16.

The filter pair 34*a* may be a pair selected from a library of predefined HRTF filters and a separate pair of equalisation filters 34*b* may be used to apply the tonal correction. However, it is preferred that the equalisation filters 34*b* are incorporated into the HRTF filter pair 34*a,* thus saving the extra processing required for the equalisation. The HRTF filter set 34 (comprising the pairs of filters 34*a* and 34*b*) is "normalised" using a transfer function which corresponds to that associated with a listener listening to a pair of loudspeakers arranged in front of the listener to subtend an angle of ±30° azimuth in front of the listener. The practice of "normalisation" not only saves processing power, but also simplifies the way in which the signals corresponding to the artificial-head signals generated during recording, and the synthesised binaurally-placed signals, can be mixed together. For a fuller explanation of this, attention is directed to our International Patent Application No. (WO95/15069). Normalisation in this way provides the correct tonal correction for listening to the loudspeakers placed at ±30° azimuth in front of the listener, but would not give exactly the right tonal correction for earphones located at ±90°. Most people do not realise or notice the tonal changes between headphones and loudspeaker auditioning, probably because they adapt to the differences quickly. However for three-dimensional synthesis, the tonal differences can influence the effectiveness of the binaural sound cues, and it is beneficial to ensure correctness of the transfer function of the sound signals from the recorded medium into the ears of the listener.

This could be achieved by having two separate sets of HRTF filters 34: one set normalised for headphone listening and the other set normalised for loudspeaker listening. However this would require a lot of computer memory space and this is not preferred. The preferred solution, is to use the one set of HRTF filters 34 normalised for listening to loudspeakers set at ±30° azimuth, (default setting) and then using a correction means apply an equalisation correction signal to the binaurally placed signals to equalise the signals for ±90° and −90° positions of the headphones (when headphones are being used). Such a correction signal, in principle, would be a factor equal to the ±30° transfer function divided by the ±90° function. Even better results can be obtained by calculating the transfer function for the exact ±90° position, by taking measurements from headphones placed directly on to an artificial-head. This would take into account the additional factors that headphone listening introduces other than the ±90° source position, such as the resonant cavity (of circumaural headphones), and the low-frequency boost caused by having the sound transducer in a near-field location, rather than far-field. In this case, the correction signal would be equal to the factor of the ±30° transfer function divided by the headphone transfer function (as measured by placing the headphones on an artificial head). The numerator of the correction factor will always be the transfer function used for the original normalisation.

In operation of the apparatus of FIG. 3, when the headphone plug 24 is not plugged into socket 18, playback is through the loudspeakers 20, 22 and the cross-talk cancellation circuits 10 are employed to eliminate the transaural cross-talk. In this mode of operation the equalisation circuits are set so that the HRTF filters sets 34 are normalised for listening to the loudspeakers 20, 22 placed at ±30°. Referring now to FIG. 4, with the headphone plug 24 inserted into the socket 18, the loudspeakers 20, 22 are disconnected and the cross-talk cancellation circuits are switched out of circuit (hence crosstalk is not cancelled) and the equalisation circuits are switched to a second state where the transfer function of the HRTF filter sets 34 is that for listening through the headphones at ±90°.

Advantages of the invention are as follows:

(a) the invention provides an optimal, three-dimensional sound-field automatically for the user during both loudspeaker and headphone auditioning.

(b) little or no additional signal-processing is required. The signal-processing system is simply reconfigured in an alternative manner, hence the cost of implementation is low.

(c) the invention has universal application to all two-loudspeaker 3D-sound reproduction systems, including hi-fi, television, computer games systems, video and musical instruments.

(d) the invention can be used with a variety of 3D-audio systems which depend on sweet-spot operation.

We claim:

1. Stereophonic sound reproduction apparatus comprising an input means for producing binaural signals, cross-talk cancellation means, loudspeaker means, headphone means, and a switch means which in a first position couples the binaural signals from the input means to the loudspeaker means through the cross-talk cancellation means and in a second position renders the cross-talk cancellation means inoperable and couples the binaural signals from the input means to the headphones, wherein there is provided a socket means for receiving a jack plug of said headphone means, said socket means including detection means operable to detect insertion of the jack plug in said socket means and in response thereto to switch the switch means to said second position.

2. Apparatus according to claim 1 therein the socket means is incorporated in a signal distribution means which is operable to provide output binaural signals to said loudspeaker means.

3. Apparatus according to claim 1 wherein there is provided a signal processing means which includes binaural placement filter means for generating left and right binaural signals, the input means is operable to produce a monophonic output audio signal, and the signal processing means is operable to receive said output signal and send said left and right binaural signals either through said cross-talk cancellation means to a respective left and right loudspeaker of said loudspeaker means when the switch means is in said first position or to a respective left and right headphone of said headphone means when said switch means is in said second position.

4. Apparatus according to claim 3 wherein the signal processing means further includes equalisation filter means, said equalisation filter means being selectively switchable by said switch means to a first state when the switch means is in said first position, where the transfer function of the equalisation filter means corresponds to that for a listener listening to sound from said loudspeaker means, to a second state where the transfer function of the equalisation filter means corresponds to that for the listener listening to sound from said headphone means.

5. Apparatus according to claim 4 wherein the equalisation filter means has a transfer function "normalised" using a transfer function which corresponds to that for a listener listening to sound reproduced by the loudspeaker means and a correction means is provided which is operable when the switch means is in said second position to receive binaural signals supplied to the loudspeaker means and apply thereto a correction signal so as to alter the binaural signals and supply corrected binaural signals to said headphone means.

* * * * *